US008659496B1

(12) United States Patent
Furey

(10) Patent No.: US 8,659,496 B1
(45) Date of Patent: Feb. 25, 2014

(54) HEAT SINK FOR A HIGH POWER ANTENNA

(75) Inventor: Joseph J. Furey, Grand Haven, MI (US)

(73) Assignee: R.A. Miller Industries, Inc., Grand Haven, MI (US)

( * ) Notice: Subject to any disclaimer, the term of this patent is extended or adjusted under 35 U.S.C. 154(b) by 449 days.

(21) Appl. No.: 12/954,187

(22) Filed: Nov. 24, 2010

(51) Int. Cl.
*H01Q 1/50* (2006.01)

(52) U.S. Cl.
USPC ..... 343/860

(58) Field of Classification Search
USPC ..... 343/860, 790–793
See application file for complete search history.

(56) References Cited

U.S. PATENT DOCUMENTS

| | | | | |
|---|---|---|---|---|
| 3,950,757 | A | 4/1976 | Blass | |
| 4,542,437 | A | 9/1985 | Ellis et al. | |
| 5,280,412 | A * | 1/1994 | Podell et al. | 361/710 |
| 5,594,461 | A | 1/1997 | O'Neill, Jr. | |
| 6,429,821 | B1 * | 8/2002 | Lewis, Jr. | 343/749 |
| 6,552,692 | B1 * | 4/2003 | Zeilinger et al. | 343/792 |
| 6,765,535 | B1 | 7/2004 | Brown et al. | |
| 7,046,583 | B2 | 5/2006 | Andreis et al. | |
| 7,053,850 | B1 | 5/2006 | Bogdans et al. | |
| 7,164,389 | B1 * | 1/2007 | Platt | 343/790 |
| 7,180,460 | B1 * | 2/2007 | Bogdans et al. | 343/792 |
| 7,609,215 | B2 * | 10/2009 | Apostolos | 343/711 |
| 7,705,692 | B2 * | 4/2010 | Fukamachi et al. | 333/109 |
| 2007/0207748 | A1 * | 9/2007 | Toncich | 455/107 |
| 2008/0136716 | A1 | 6/2008 | Annamaa et al. | |
| 2008/0212283 | A1 | 9/2008 | Chernyakov et al. | |
| 2009/0011922 | A1 * | 1/2009 | de Rochemont | 501/137 |
| 2010/0156736 | A1 * | 6/2010 | Chung et al. | 343/793 |
| 2012/0112974 | A1 * | 5/2012 | Martek et al. | 343/749 |

FOREIGN PATENT DOCUMENTS

| | | |
|---|---|---|
| WO | 02/065580 A1 | 8/2002 |

* cited by examiner

*Primary Examiner* — Huedung Mancuso
(74) *Attorney, Agent, or Firm* — McGarry Bair PC

(57) ABSTRACT

A mobile multiband antenna has a frequency matching circuit located in a base mount housing for mounting the antenna to a carrier. A heat sink is located on a reverse side of the frequency matching circuit. One or more resistors in the frequency matching circuit are mounted to the heat sink to dissipate heat.

11 Claims, 7 Drawing Sheets

HEAT SINK FOR A HIGH POWER ANTENNA

BACKGROUND OF THE INVENTION

Multiband dipole antennas can transmit and/or receive in multiple frequency bands and may be adapted to be mounted to a carrier, such as a vehicle. Known mobile antennas may have connectors between a radiator and a mount, or with connectors between lower and upper ends of an antenna that breaks in a radiator. Multiband antennas with two or more frequency ranges may utilize more electronic components, than a single band antenna. That, coupled with a size restriction implied for the mobility of the antenna, may lead to a higher packing density of the components desired to fit within existing connector housings. Many of those components may generate heat during operation of the antenna. It is especially true for higher power antennas, which may generate more heat than can safely be handled by existing connections.

SUMMARY OF THE INVENTION

A mobile multiband antenna includes a base mount housing having a high heat conductive property for mounting the antenna to a carrier. A first printed circuit board made of a high heat conductive material is directly mounted to the base mount housing. A high frequency matching circuit on the first printed circuit board has one or more resistors mounted directly to the base mount housing via a recess in the first printed circuit board. A second printed circuit board is directly mounted to the base mount housing and spaced from the first printed circuit board. The second printed circuit board has obverse and reverse sides. A low frequency matching circuit having at least one component is located on the obverse side, and a heat sink made of a high heat conductive material is on the reverse side. One or more resistors is mounted to the heat sink on the reverse side.

DESCRIPTION OF EMBODIMENTS OF THE INVENTION

Figure 1:
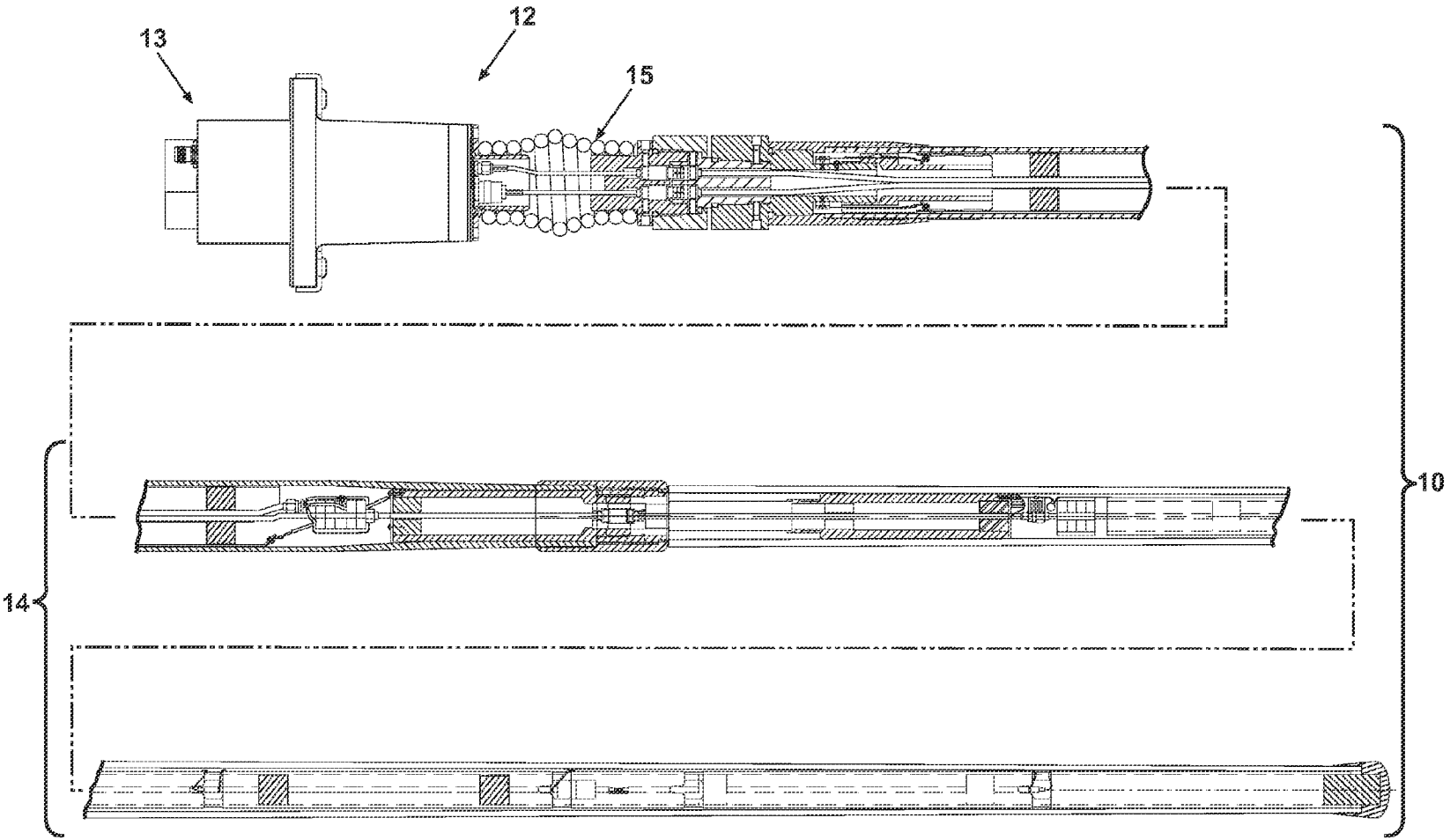
FIG. 1 is a cross sectional view of a multiband antenna.
Figure 2:
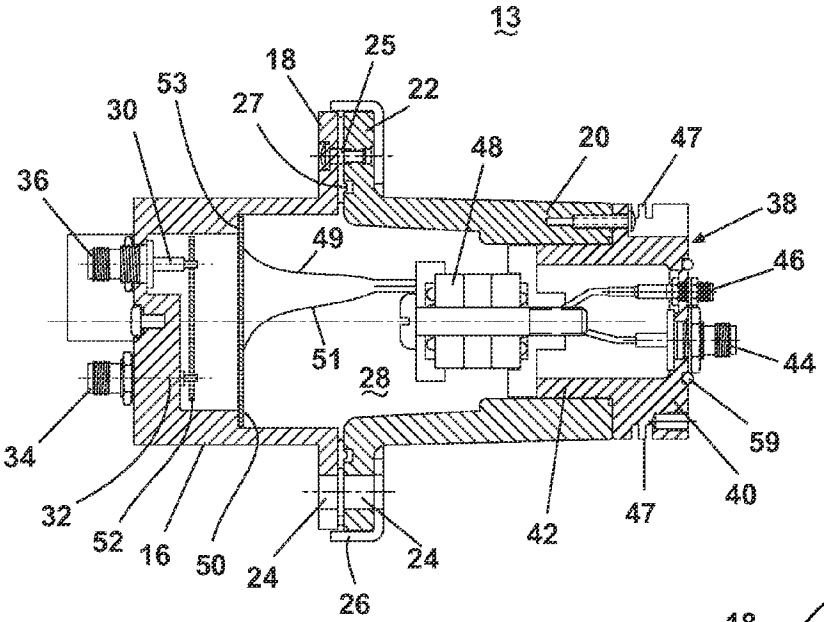
FIG. 2 is an enlarged cross sectional view of the base mount subassembly of FIG. 1.

Looking first at FIG. 1, there is shown a cross sectional view of an exemplary multiband antenna 10. The multiband antenna 10 is described and shown for illustrative purposes and is not intended to be limiting. The multiband antenna 10 may have a mount assembly 12 and a whip assembly 14. The mount assembly 12 may have a base mount subassembly 13 and a spring mount assembly 15. Looking also at FIG. 2, the base mount subassembly 13 comprises a hollow base mount housing 16 with an annular mounting flange 18, and a hollow, generally cylindrical, base support 20, having a matching annular flange 22. The annular flanges 18, 22 are disposed facing each other with a plurality of mounting holes 24 in registry. The base mount housing 16 is secured to the base support 20 by fasteners 25 spaced between the mounting holes 24, and preferably sealed by a gasket 27 or similar seal. The base mount housing 16 and base support 20 thus form an interior chamber 28. A reinforcement ring 26 (also having a plurality of mounting holes 24) is received over the base support 20 with the holes in registry. The mounting holes 24 are all sized so that mounting bolts (not shown) can be utilized to secure the mount assembly 12 to a carrier. The carrier can be any mobile or immobile apparatus or structure which the base mounting 16 may be mounted to. Some non-limiting examples of the carrier are: a vehicle, a ship, a field station, etc.

In this embodiment, two connectors 34, 36 are attached to and extend from the base mount housing 16. Two cable leads 30, 32 extend from the two connectors 34, 36 into the interior chamber 28 to eventually electrically connect to two transmission lines in the whip 14. A base cover 38, preferably made of aluminum or other highly conductive material, has a mount portion 40 and a stepped insert portion 42, which is received in the open end of the base support 20. The base cover 38 is secured to the base support 20 by conventional means. In the illustrated embodiment, the base cover 38 mounts two connectors 44, 46. The exterior of the mount portion 40 has cooling fins to radiate heat that may build up within the chamber 28.

It will be seen that the interior chamber 28 houses a cable choke 48 with leads running from the connectors 44, 46. The cable choke 48 is preferably mounted to the base cover 38 and comprises windings on a ferrite core to attenuate undesirable currents from the whip assembly 14. Other acceptable forms for the cable choke 48 may include coiling the leads and mounting ferrite beads over the leads. Also, the ferrite core can be linear or toroidal, as dimensions within the interior chamber 28 permit. Cooling fins 47 on the base cover 38 help dissipate heat generated in the cable choke 48. The interior chamber 28 can also house matching circuits as needed. For example, in this embodiment, leads 49, 51 from the cable choke 48 extend first to a low frequency matching circuit 50, and then to a high frequency matching circuit 52, optionally separated from each other by an RF shield 53. The two connectors 34, 36 connect to the high frequency matching circuit 52 and to the low frequency matching circuit 50, respectively, by way of the leads 32, 30.

Figure 3:
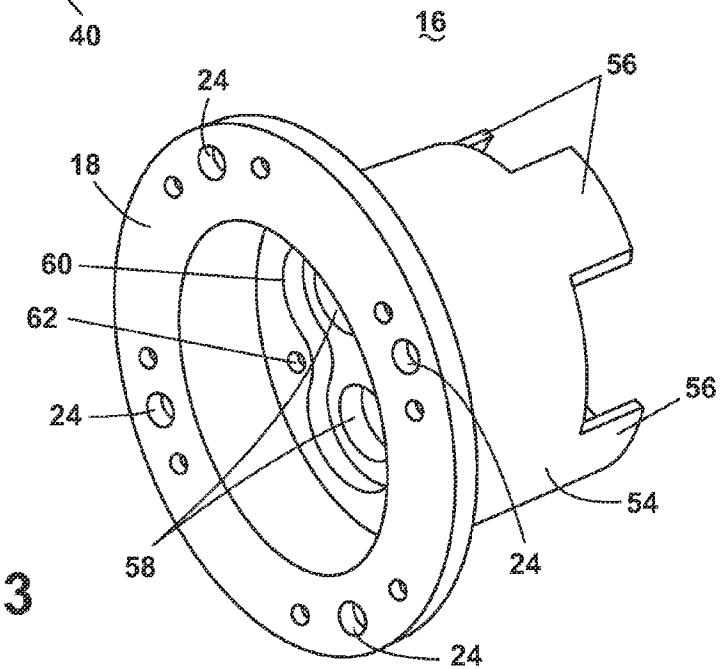
FIG. 3 is a perspective view of the base mount housing of FIGS. 1 and 2.

Looking also at FIG. 3, there is illustrated a perspective view of the base mount housing 16. The base mount housing 16 has a cylindrical body 54 and the annular mounting flange 18. The cylindrical body 54 and the flange 18 can be made as one piece or separately followed by an appropriate bonding.

Anchoring protrusion members 56 may be provided for engagement with a carrier. Openings 58 are provided in the bottom of the cylindrical body 54 for insertion of the connectors, such as the cable connectors 34 and 36. One or more ears 60 may be provided along an interior wall of the cylindrical body 54. The ears 60 may be of any suitable shape and may be provided with a plurality of mounting holes 62 for securing the low frequency matching circuit 52. Although only three anchoring protrusion members 56, three openings 58 and three ears 60 are illustrated in FIG. 3, it will be understood that any number of the protrusion members 56, openings 58 and ears 60 can be used in the present invention. The base mount housing 16 is can be made of any suitable material having a high heat conductive property. Metals, such as aluminum, and metal alloys are one non-limiting examples of a suitable material.

Figure 4:
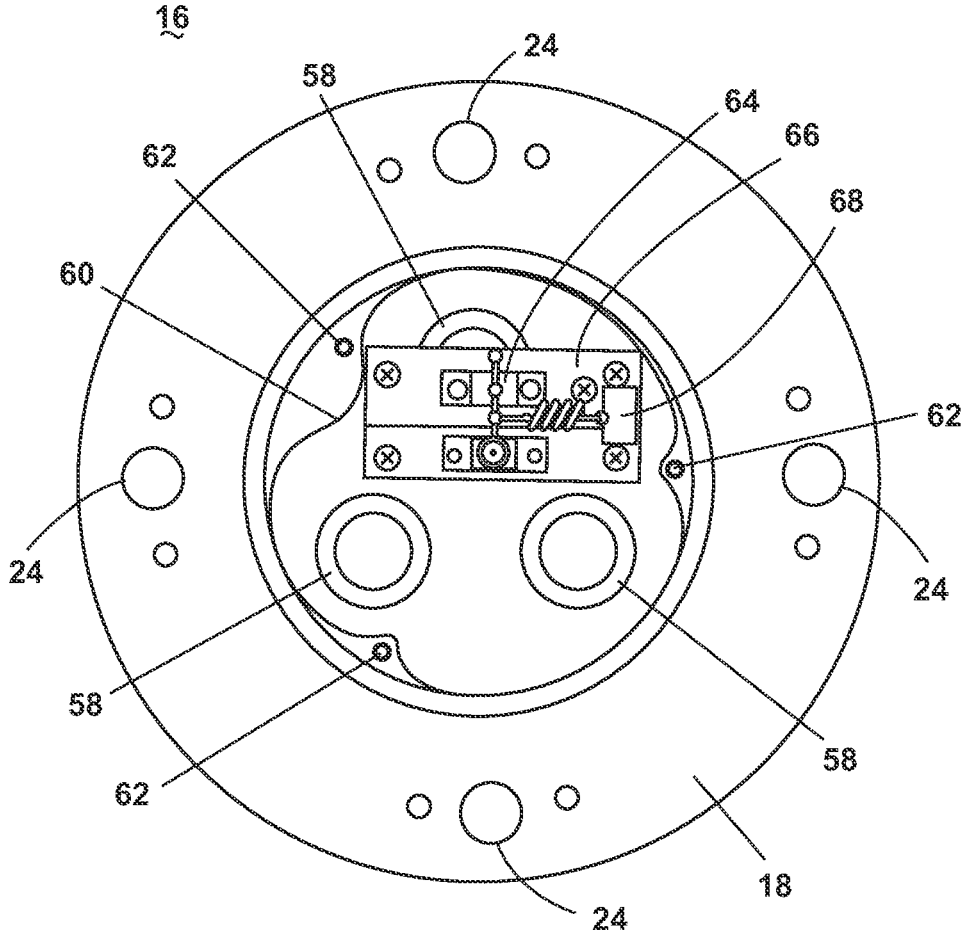
FIG. 4 is a front view of a high frequency matching circuit mounted to the bottom of the base mount housing according to one embodiment.

FIG. 4 demonstrates the high frequency matching circuit 52 mounted to the bottom of the base mount housing 16 according to one embodiment. This direct mounting enables improved dissipation of heat generated by the components of the high frequency matching circuit 52. The high frequency matching circuit 52 may be designed to operate in the 550-2000 MHz range and may have circuit components as know in the art. In the illustrated exemplary embodiment, a resistor 64 is mounted to the bottom of the cylindrical body 54 via a recess in a printed circuit board (PCB) 66. Another resistor 68 may be mounted directly to the bottom of the cylindrical body 54. Shown arrangement of the resistors 64 and 68 also enable a better heat transfer to the base mount housing 16 for an improved heat dissipation. Any or all components of the high frequency matching circuit 52 may be directly mounted to the bottom of the cylindrical body 54. Alternatively or additionally a suitable high heat conductive material may be used as a material of the PCB 66. The components of the high frequency matching circuit 52 are not otherwise germane to this invention, and will not be described herein in further detail.

Figure 5:
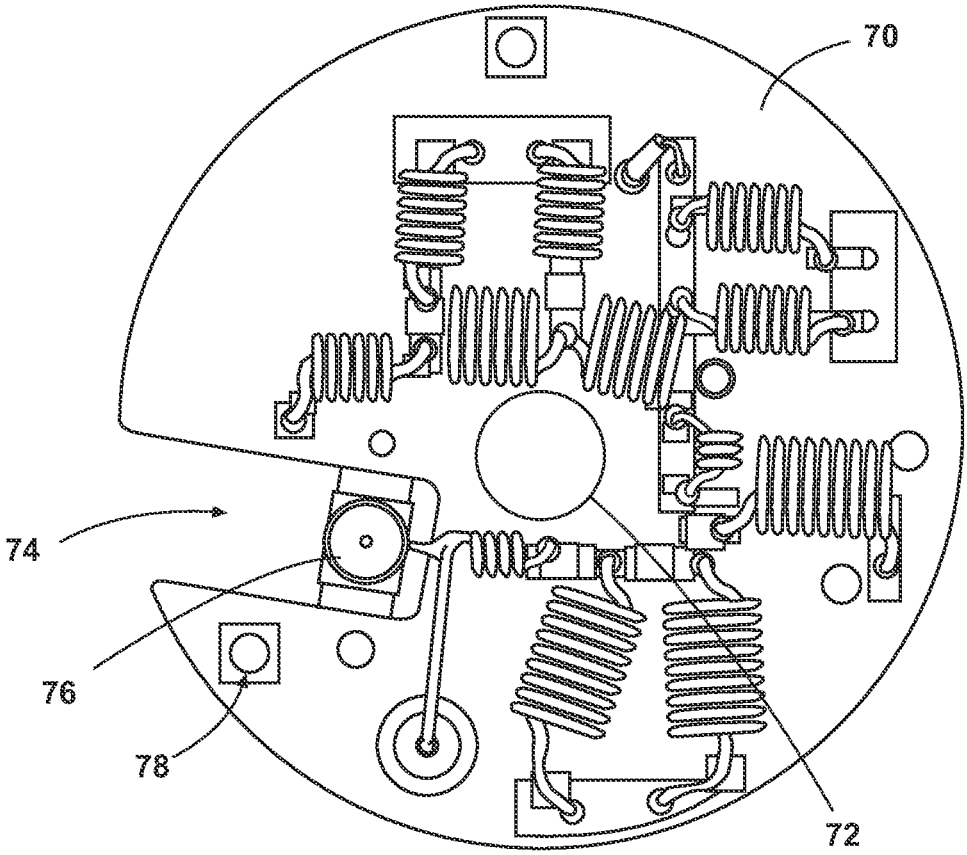
FIG. 5 is an obverse side of a low frequency matching circuit according to one embodiment.
Figure 6:
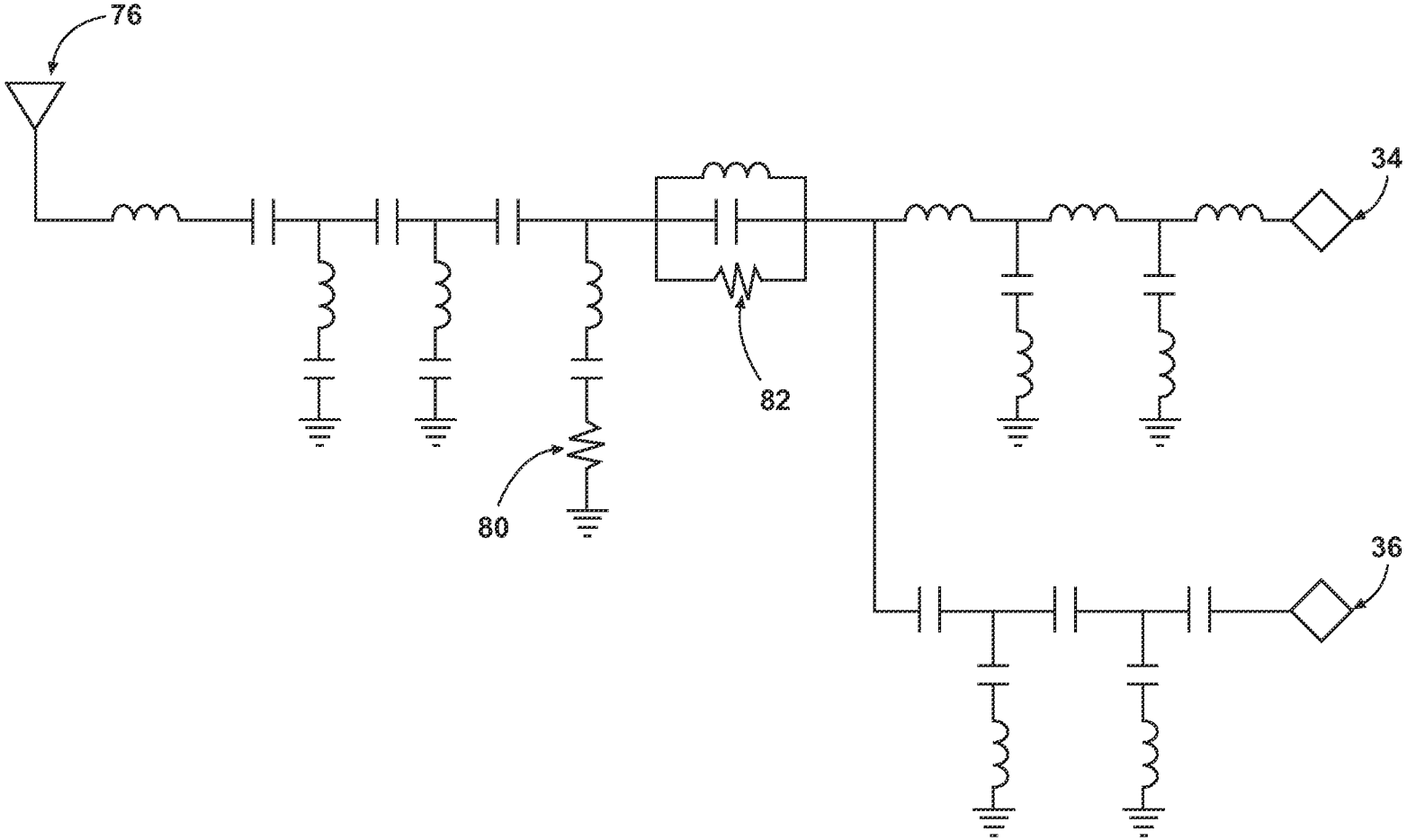
FIG. 6 is a diagram of the low frequency matching circuit of FIG. 5

Turning now to FIG. 5, there is shown an obverse side of the low frequency matching circuit 50. The low frequency matching circuit 50 may be designed to operate in the 30-512 MHz range and may have circuit components arranged on a circularly shaped PCB 70. The PCB 70 may have an opening 72 for a feed through input cable of the high frequency matching circuit 52 and a channel 74 for an input 76 of the low frequency matching circuit 50. Mounting holes 78 may be provided for a secure attachment of the PCB 70 to the ears 60 in the base mount housing 16, spaced from the low frequency matching circuit. The circuit components of the low frequency matching circuit 50 are shown in a diagram of FIG. 6. There are two resistors 80 and 82 shown among other circuit components. The other components of the low matching circuit 50 are not otherwise germane to this invention, not intended to be limiting and, therefore, will not be described herein in further details.

Figure 7:
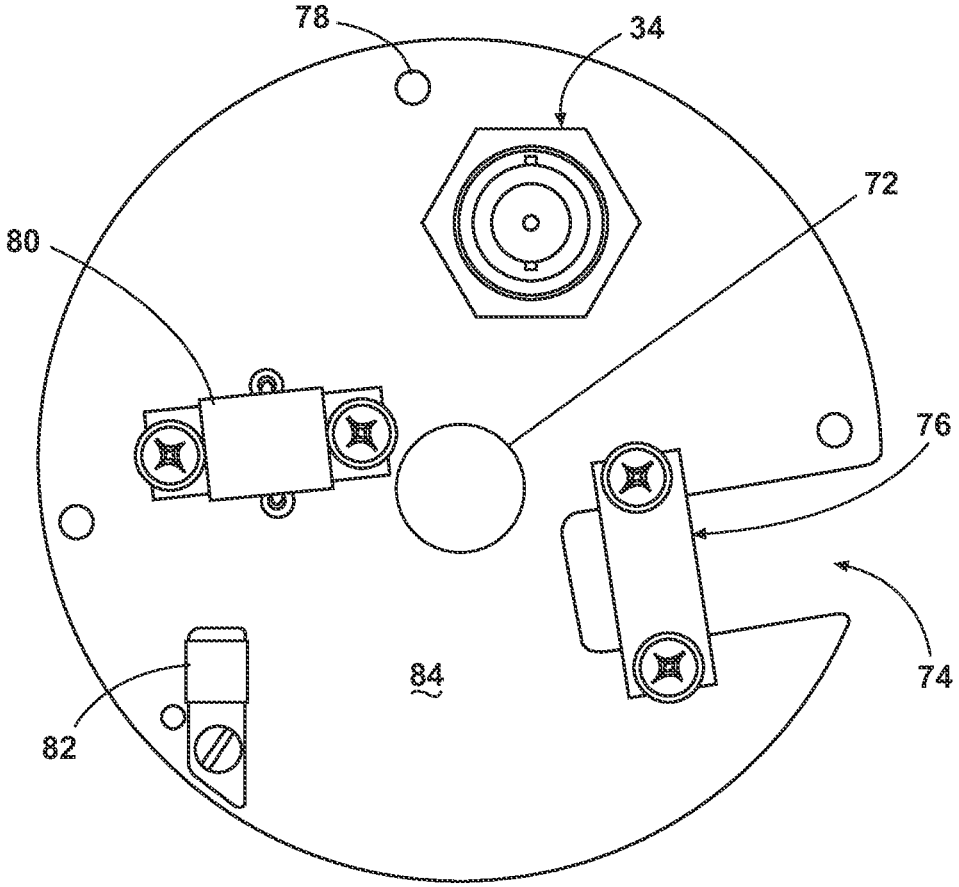
FIG. 7 is a reverse side of the low frequency matching circuit of FIG. 5.

The resistors 80 and 82 may generate a significant amount of heat, which may cause malfunctioning of the low frequency matching circuit 50 if not sufficiently dissipated. To address this problem, both resistors 80 and 82 are mounted to a heat sink 84 located on the reverse side of the PBC 70 as demonstrated by the FIG. 7. The heat sink 84 repeats a PBC 70 contour and is made of any suitable high heat conductive material. There is also shown one of the two outputs in the low frequency matching circuit 50 to connectors 34 and 36. As illustrated in FIG. 7 the resistor 82 can be countersunk into the heat sink 84. It will be understood that both or either resistor 80 and 82 may be countersunk into the heat sink 84.

Figure 8:
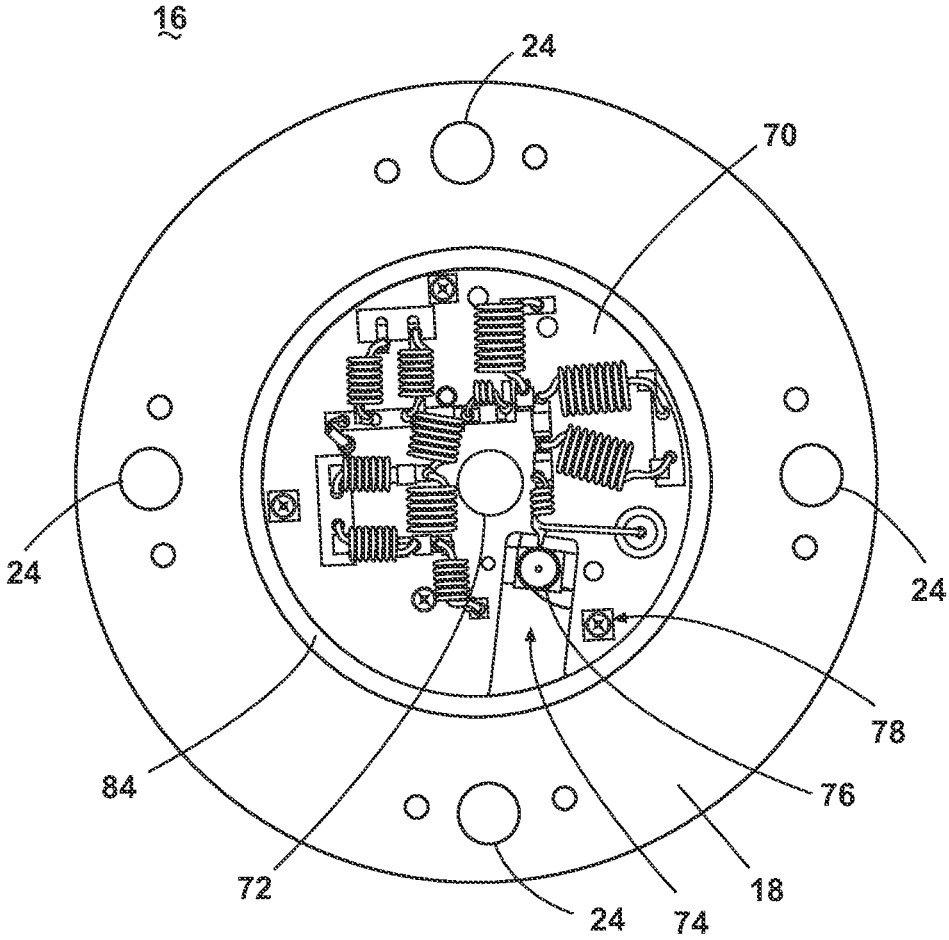
FIG. 8 is a front view of the base mount housing with the assembled low and high frequency matching circuits.

FIG. 8 shows the base mount housing 16 with assembled circuits 50 and 52. The low frequency matching circuit 50 mounted to the ears 60 in the base mount housing 16 blocks the view of the high frequency matching circuit 52. The low frequency matching circuit 50 may be a snug fit within the cylindrical body 54 for a better heat dissipation from the heat sink 84 to the heat conductive base mount housing 16. Alternatively, the low frequency matching circuit 50 may have a small gap 84 between the outer edge of the circular PBC 70 and the housing 16, as illustrated in the FIG. 8. The high frequency matching circuit 52 is located below at the bottom of housing 16, as shown in FIG. 4.

The base mount housing 16 may additionally have a number of fins or apertures (not shown) located on the surface area of the cylindrical body 54, to further improve dissipation of heat generated by circuits 50 and 52.

While the invention has been specifically described in connection with certain specific embodiments thereof, it is to be understood that this is by way of illustration and not of limitation, and the scope of the appended claims should be construed as broadly as the prior art will permit.

What is claimed is:

1. A mobile multiband antenna comprising:

a base mount housing having a high heat conductive property for mounting the antenna to a carrier, a first printed circuit board made of a high heat conductive material, directly mounted to the base mount housing, a high frequency matching circuit having at least one resistor mounted directly to the base mount housing via a recess in the first printed circuit board, a second printed circuit board, directly mounted to the base mount housing and spaced from the first printed circuit board, the second printed circuit board having obverse and reverse sides, low frequency matching circuit having at least one component located on the obverse side, and a heat sink made of a high heat conductive material on the reverse side, wherein at least one resistor mounted to the heat sink on the reverse side.

2. The mobile multiband antenna of claim 1 further comprising two resistors mounted to the heat sink on the reverse side.

3. The mobile multiband antenna of claim 1 wherein the heat sink repeats a contour of the printed circuit board.

4. The mobile multiband antenna of claim 1 wherein the at least one resistor is countersunk into the heat sink.

5. The mobile multiband antenna of claim 1, wherein the base mount housing comprises a cylindrical body and the second printed circuit board is snug fit within the cylindrical body.

6. The mobile multiband antenna of claim 5 wherein the high frequency matching circuit spaced below the low frequency matching circuit.

7. The mobile multiband antenna of claim 5 further comprising two resistors mounted to the heat sink on the reverse side.

8. The mobile multiband antenna of claim 2, wherein the two resistors are countersunk into the heat sink.

9. A method of providing heat dissipation in a mobile multiband antenna with a frequency matching circuit located in a base mount housing and at least one resistor in the frequency matching circuit, comprising:

providing a first printed circuit board having a high heat conductive material, directly mounted to the base mount housing, locating at least one resistor mounted directly to the base mount housing via a recess in the first printed circuit board, providing a second printed circuit board, directly mounted to the base mount housing and spaced from the first printed circuit board, the second printed circuit board having obverse and reverse sides, mounting a heat sink on the reverse side, and mounting at least one resistor to the heat sink.

10. The method of claim 9, wherein the frequency matching circuit is a high frequency matching circuit.

11. The method of claim 9, wherein the frequency matching circuit is a low frequency matching circuit.

* * * * *

UNITED STATES PATENT AND TRADEMARK OFFICE

CERTIFICATE OF CORRECTION

PATENT NO. : 8,659,496 B1
APPLICATION NO. : 12/954187
DATED : February 25, 2014
INVENTOR(S) : Joseph J. Furey It is certified that error appears in the above-identified patent and that said Letters Patent is hereby corrected as shown below:

In the CLAIMS:

Column 4, Claim 6, line 39, reads: "...high frequency matching circuit spaced below the low..."

It should read: "...high frequency matching circuit is spaced below the low..."

Signed and Sealed this
Thirteenth Day of May, 2014

Michelle K. Lee

Michelle K. Lee
*Deputy Director of the United States Patent and Trademark Office*